United States Patent [19]

Griesedieck, III et al.

[11] Patent Number: 4,988,045

[45] Date of Patent: Jan. 29, 1991

[54] VERTICAL SCRAP METAL CRUSHER

[75] Inventors: Henry C. Griesedieck, III, Manchester; Sven B. Strom, St. Louis, both of Mo.

[73] Assignee: American Pulverizer Company, St. Louis, Mo.

[21] Appl. No.: 37,733

[22] Filed: Apr. 13, 1987

[51] Int. Cl.[5] ..... B02C 25/00

[52] U.S. Cl. ..... 241/36; 241/37; 241/257 R; 241/285 A

[58] Field of Search ..... 241/32, 37.5, 33, 37, 241/36, 257 R, 257 G, 285 A

[56] References Cited

U.S. PATENT DOCUMENTS

| | | | |
|---|---|---|---|
| 3,090,900 | 5/1963 | Porter et al. | 241/32 X |
| 3,703,970 | 11/1972 | Benson | 241/32 X |
| 3,813,045 | 5/1974 | Greiffenstern | 241/285 A X |
| 4,140,282 | 2/1979 | Steimel | 241/36 |
| 4,351,485 | 9/1982 | Hardwick et al. | 241/36 |
| 4,529,134 | 7/1985 | Williams | 241/36 X |
| 4,709,197 | 11/1987 | Goldhammer et al. | 241/36 X |

FOREIGN PATENT DOCUMENTS

| | | | |
|---|---|---|---|
| 835487 | 6/1981 | U.S.S.R. | 241/285 A |
| 884242 | 12/1961 | United Kingdom | 241/32 |

*Primary Examiner*—Joseph M. Gorski
*Attorney, Agent, or Firm*—Paul M. Denk

[57] ABSTRACT

A scrap metal crusher includes a tapered chamber having a relatively large inlet at one end and a relatively small outlet at the opposite end of the chamber. A rotary crusher arm is axially mounted for rotation in the tapered chamber. A plurality of vanes are disposed along the inner surface of the tapered chamber, which vanes in cooperation with the rotary crusher arm convey scrap inserted into the inlet of the tapered chamber toward the outlet of the chamber while simultaneously crushing the scrap. A throat disposed adjacent the outlet of the chamber allows passage of crushed scrap therethrough to a discharge chute. The throat is automatically enlarged upon jamming of the crusher to permit any material causing the jamming to pass through the throat to the discharge chute.

8 Claims, 3 Drawing Sheets

VERTICAL SCRAP METAL CRUSHER

BACKGROUND OF THE INVENTION

This invention relates generally to scrap handling apparatus and more particularly to a crusher for metal turnings and the like.

Various machines, called crushers, are available for reducing metal chips and turnings to reduce the volume of the scrap. Conventional crushers, however, could be improved. Conventional crushers are subject to jamming when a piece of tramp metal such as a metal bar or the like is accidentally fed into the crusher. Heretofore, jamming of such a metal bar has required manual intervention. Access to the jammed article in the machines has heretofore been made from the top of the crusher or through various manually operated and normally secured doors in the crusher itself. Finding and removing the jammed article was a time-consuming process which unnecessarily exposed the crusher operator to the scrap being crushed.

SUMMARY OF THE INVENTION

Among the various objects and features of the present invention may be noted the provision of a crusher which requires less manual attention.

Another object of the present invention is the provision of such a crusher which automatically responds to the presence of a jam to automatically clear the jam when possible.

A third object of the present invention is the provision of such a crusher which clears jamming with a minimum of interference with the normal operation of the crusher.

Other objects and features will be in part apparent and in part pointed out hereinafter.

Briefly, a vertical scrap metal crusher of the present invention includes a tapered chamber having a relatively large upper disposed inlet at one end and a relatively small lower outlet at the opposite end of the chamber. A rotary crusher arm is axially mounted for rotation in the tapered chamber. A plurality of vanes are disposed along the inner surface of the tapered chamber, the rotary crusher arm and the vanes being cooperatively disposed to convey scrap inserted into the inlet of the tapered chamber toward the outlet of the chamber while simultaneously crushing the scrap. The crusher includes a throat disposed adjacent the outlet end of the chamber for passage of crushed scrap therethrough to a discharge chute. Structure is provided for automatically enlarging the throat upon jamming of the crusher to permit material causing the jamming to pass through the throat to the discharge chute.

BRIEF DESCRIPTION OF THE DRAWINGS

Similar reference characters indicate similar parts throughout the several views of the drawings.

DESCRIPTION OF THE PREFERRED EMBODIMENT

Figure 1:
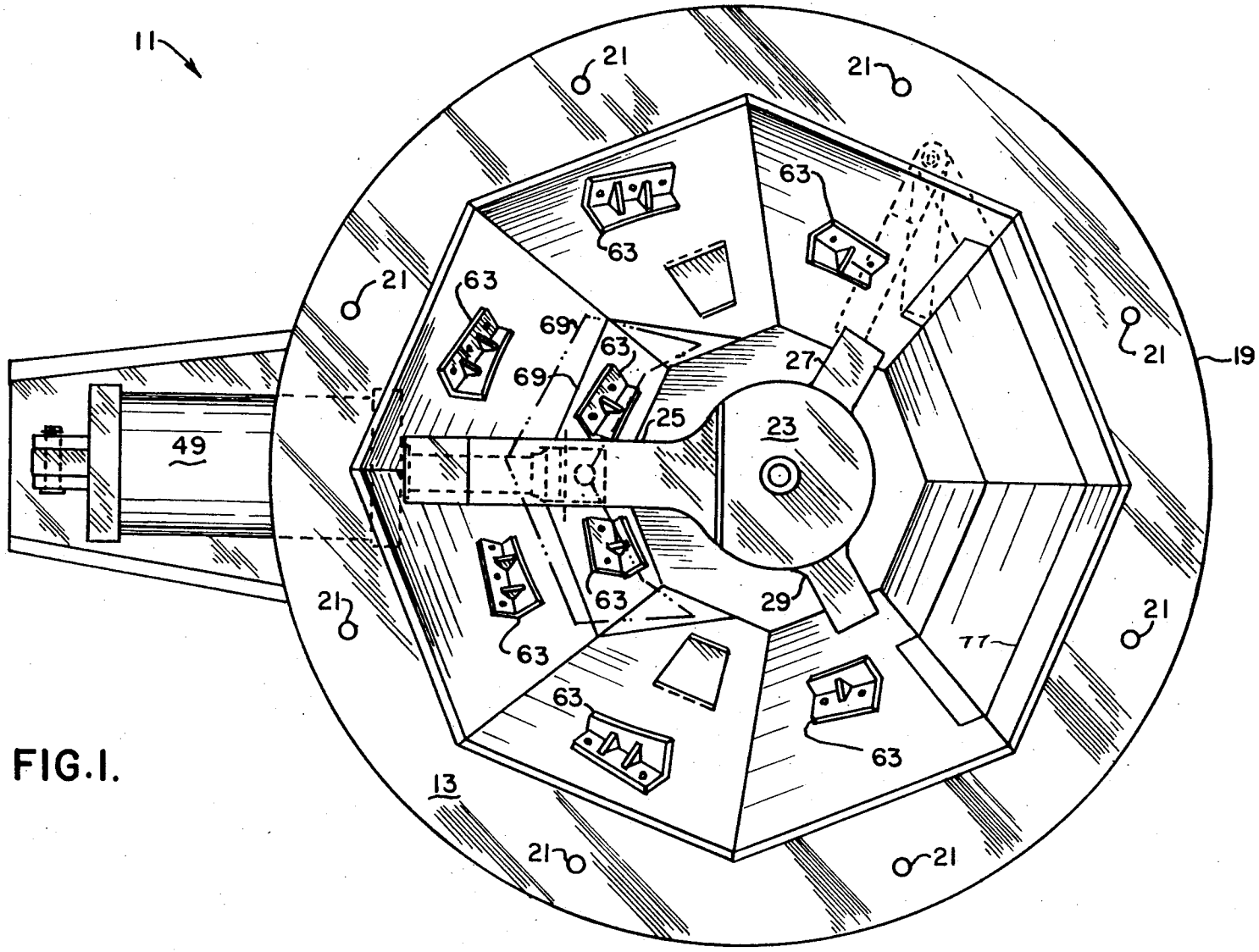
FIG. 1 is a top plan of the crusher of the present invention.

A scrap crusher 11 of the present invention (FIGS. 1 and 2) includes an upper chamber 13 having an inlet indicated generally at 15 (FIG. 2) and an outlet indicated at 17. Upper chamber 13 is generally vertically disposed and has a flange 19 with openings 21 therethrough so that a hopper (not shown) may be secured thereto if desired. Upper chamber 13 is tapered from its inlet to its outlet. A rotor head 23 carrying three rotor arms 25, 27 and 29 is axially disposed in upper chamber 13 and secured for revolution therein. Crusher arm 25 extends upwardly farther than arms 27 and 29 in upper chamber 13 and in fact extends beyond the upper portion of the chamber. Rotor arm 25 includes a plurality of teeth 31 for engaging the turnings or other scrap in the upper portion of upper chamber 13. Similarly, lower crusher arms 27 and 29 include a plurality of teeth 33 for engaging the scrap in the lower portions on the upper chamber.

Figure 2:
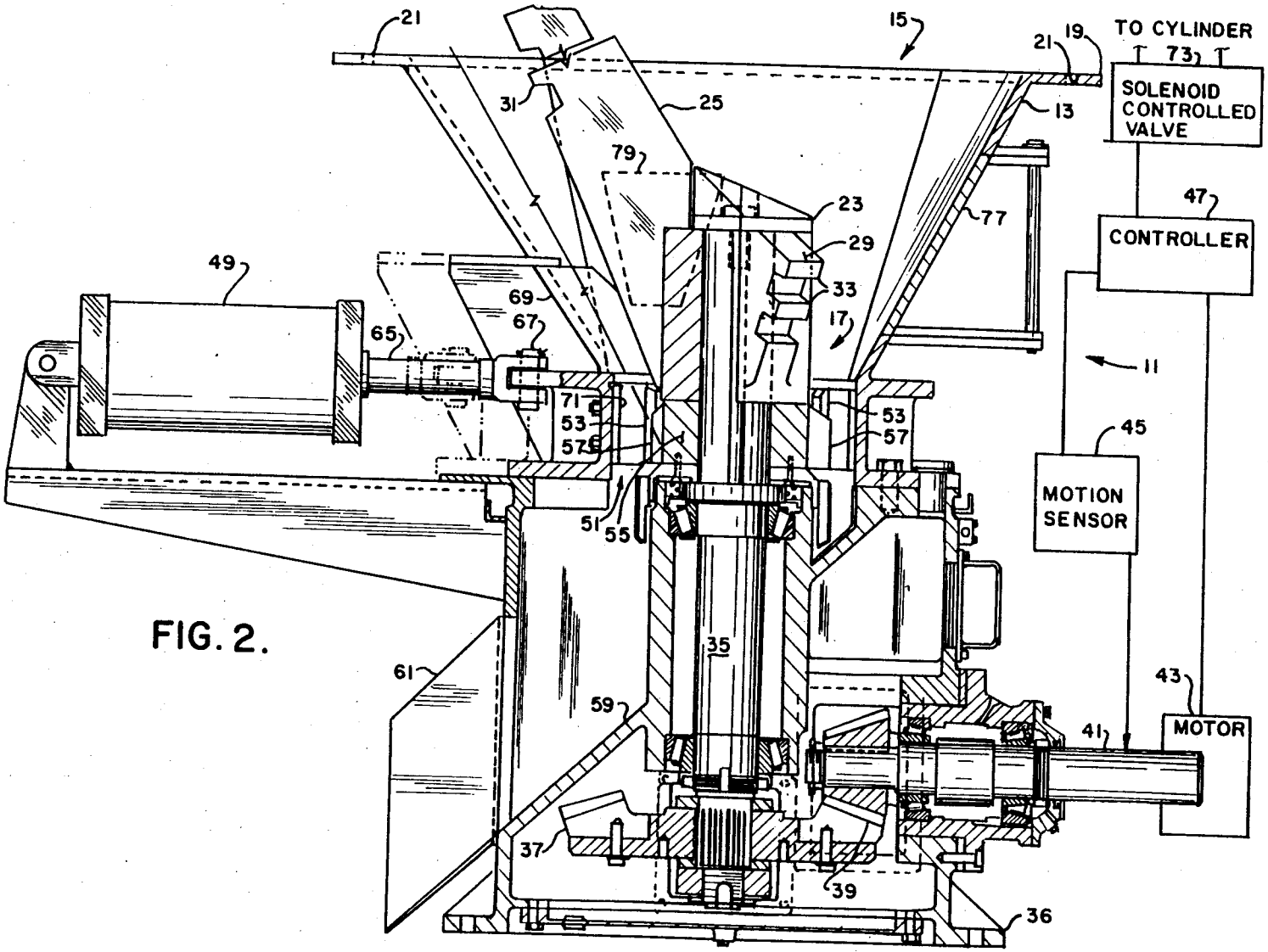
FIG. 2 is a side elevation, with parts broken away for clarity, of the crusher of FIG. 1 showing a drive motor and control circuitry therefor in block diagram form.

Rotor head 23 and accompanying arms 25, 27 and 29 are suitably secured to a keyed, vertically extending rotor shaft 35 which is suitably held in place with respect to a frame 36 by conventional bearings and washers. At the base of rotor shaft 35 there is disposed a straight bevel gear 37 which drives shaft 35. Bevel gear 37 is in turn driven by a bevel pinion 39 suitably mounted to a pinion shaft 41. Although all the bearings and washers for this drive mechanism are shown in FIG. 2, they are not described herein in detail because of their conventional construction.

Pinion shaft 41 is driven by a reversible motor 43, which may include any desired transmission mechanism. A motion sensor 45 senses the speed of pinion shaft 41, for reasons which will become apparent below. By way of illustration, motion sensor 45 may be an optical sensor which operates in conjunction with a disc attached to pinion shaft 41 to detect motion of the pinion shaft. The output of motion sensor 45 is supplied to a controller 47, such as an Allen Bradley programmable controller type PLC-2/05. Controller 47, as will appear, controls the operation and direction of rotation of motor 43 and pinion shaft 41 and controls the operation of a hydraulic or pneumatic cylinder 49 described below.

The outlet of upper chamber 13 terminates in a restricted throat 51. Throat 51 has a plurality of vanes 53 secured to the walls of the throat and extending inwardly therefrom. Shaft 35 has secured to it in the throat area a lower rotor head 55 carrying a plurality of vanes 57 which in cooperation with vanes 53 perform the final reduction of the scrap. Below throat 51 is a sloping discharge plate 59 leading to a discharge chute 61. As shown in FIG. 2, throat 51 may be formed integrally with the portion of upper chamber 13 adjacent outlet 17.

As shown in FIG. 1, the upper chamber 13 as well as throat 51 include a plurality of vanes. The vanes in the upper chamber are labeled 63.

Upper chamber 13 can receive turnings from conveyors, cranes or the like. The bundles at the bottom of the feed hopper (not shown) are engaged by long arm 25 of upper rotor head 23. Due to the many vanes 63 located on the inside of the upper housing and the teeth of the long arm of the rotor, the bundles of turnings are forced downwardly into the area of lower rotor head 55. The interaction between the arms of the rotor heads and the various vanes in the housing cause a gradual breakdown of the size of bundles and strands of turnings, with the final reduction taking place at the lower rotor head.

The piston, labeled 65, of pneumatic or hydraulic cylinder 49 is secured by a pin 67 to a door 69 which is movable by piston 65 from the closed position shown in solid lines in FIGS. 1 and 2 to the open position shown in phantom lines. As can be seen, door 69 includes a portion of the wall of upper chamber 13, extends laterally along the lower portion of upper chamber 13, and also includes the wall labeled 71 of throat 51. When piston 65 is retracted, therefore, door 69 moves to its open position, which enlarges throat 51 substantially and increases the open area in the lower portion of upper chamber 13.

The reason for opening door 69 as described above is as follows: The function of crusher 11 is to crush turnings. It is not a shearer, so that when a solid bar or the like enters the crushing area, it will most likely jam the rotor unless the bar is small enough and so situated as to pass through the throat opening. When such a temporary jam occurs, motion sensor 45, which monitors the speed of pinion shaft 41, signals controller 47 to cause crusher 11 to stop and then start a reversing motion. Controller 47 does this by controlling motor 43 to slow to a stop (if it is not completely stopped already) and then reverse. If a solid bar or the like is small enough and properly placed, it now passes through the throat and the crusher resumes normal operation. However, in many cases a solid bar or the like is too large to pass through throat 51. For this reason, door 69 is provided to slide in and out by the operation of hydraulic or pneumatic cylinder 49 as described above. By this means an additional five inches or so of throat opening is achieved on the side where door 69 is located, just above the discharge chute 61.

With the present invention, when the rotor is ready to reverse, as controlled by controller 47, a signal from controller 47 actuates a solenoid controlled valve 73 which controls the operation of cylinder 49. Solenoid controlled valve is, for example, a series D61VW pilot operated solenoid controlled directional control valve such as is sold by the Fluidpower Pump Division of Parker Fluidpower, of Otsego, Mich. As door 69 is opened, a large piece of material jammed in that area will fall into discharge chute 61. However, door 69 is not allowed to stay open. It should only open and immediately close or else bundles of turnings would fall into the large opening thus created and perhaps prevent the mechanism from subsequently completely closing. As soon as door 69 is fully open, controller 69 signals solenoid control valve 73 to close door 69. This is accomplished by timing the amount of time the piston 65 is retracted, although a position sensor could be used instead.

In the event that a single reversal of the rotor and opening of door 69 does not result in the jam being cleared, the process is repeated for a preset number of times (such as three) until the jam is cleared or the controller 47 determines that the preset number of reversals have occured without clearing of the jam. In this latter case, manual intervention is required. For this purpose, a clean out door assembly 77 is provided for manual access to the interior of upper chamber 13. In addition, a pair of upper access door 79 are also provided in upper chamber 13 to provide access to the interior of upper chamber 13 as necessary. It should be appreciated, however, that the operation of door 69 by increasing the throat area and the reversal of the rotor a preset number of times quite often results in the jam being cleared up automatically without manual intervention. This is a significant improvement over present systems which require considerably more manual attention.

Figure 3:
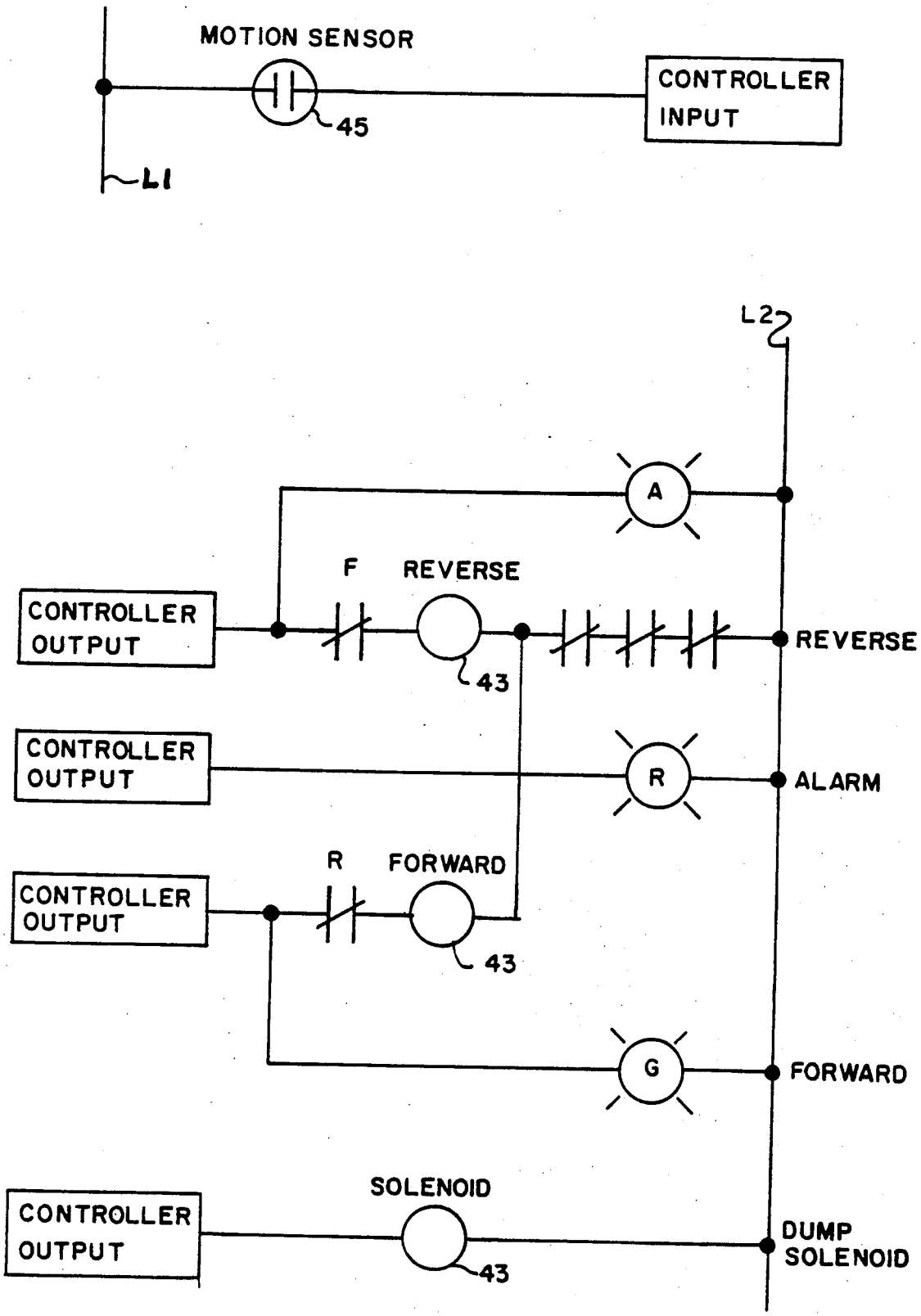
FIG. 3 is an electrical schematic illustrating the control features of the present invention.

The manner in which controller 47 actually controls the operation of crusher 11 is schematically illustrated in FIG. 3. The controller selectively completes circuits between a pair of power lines L1 and L2. Motion sensor 45 is disposed between power line L1 and one input of controller 47. Similarly, the motor 43 has its control terminals connected as shown in FIG. 3 so that a control signal on the uppermost controller output shown in FIG. 3 causes motor 43 to reverse and an amber light labeled A to light. Similarly, a control signal on the third controller output from the top of FIG. 3 causes motor 43 to resume rotation in the forward direction and a green light labeled G to light. A control signal on the bottommost controller output of FIG. 3 causes solenoid 73 to cause door 69 to open while the opposite signal on that controller output causes the door to close. The second controller output from the top causes a red alarm lamp labeled R to light.

Although controller 47 has been described as an Allen Bradley programmable controller, it should be realized that discrete control circuits or a programmed multi-purpose computer could be used to the same effect. Controller 47, no matter what its implementation, must control the crusher 11 to perform the operations as described above. These operations include sensing by means of motion sensor 45 when the motor has jammed. Once the motor completely stops, the motor is reversed by controller 47 and hydraulic or pneumatic cylinder 49 is activated to retract door 69. As soon as the door is fully retracted, a timed signal from controller 47 de-energizes solenoid controlled valve 73 to cause hydraulic cyclinder 49 to close rapidly. Note that motion sensor is sensitive not only to complete stopping of the pinion shaft but also to a shaft speed which falls below normal. This below normal speed indicates a jamming condition and the controller thereupon stops motor 43 before reversing the motor. Programmable controller 47 is set to allow time for the motor to slow down before reversing. Of course if the crusher is jammed, the motor stops immediately after being de-energized. After a preset time delay, the motor is energized in the reverse direction for a preset time, whereupon the motor is again energized for forward motion. Each time the motor is energized in the reverse direction, solenoid control valve 73 is energized to open door 69. Controller 47 is programmed to cause this cycle to occur three times. If the crusher is not cleared during these three cycles, the apparatus stops and the red alarm light is turned on by controller 47. If on the other hand during a forward motion following a reversed motion of the rotor, the forward motion is not interrupted for a set period of time, the forward motion resumes without reversing again. That is, if one reversal of the motor clears the jam, controller 47 does not go through the other two reversal cycles. This avoids many unnecessary shutdowns for minor jammings that eventually clear themselves after the first or second reversing cycles. It should be realized that controller 47 may be programmed to automatically reverse at a preset interval such as fifteen minutes so as to prevent jamming or overloading.

In view of the above, it will be seen that the various objects and features of the invention are achieved and other advantagous results obtained. As various changes could be made in the above constructions and methods without departing from the scope of the invention, it is intended that all matter contained herein and shown in the accompanying drawings shall be interpreted as illustrative and not in a limiting sense.

What is claimed is:

1. A vertical scrap metal crusher comprising:

a tapered chamber having a tapering inner surface and a pair of ends;

said tapered chamber having a relatively large inlet at one of said ends and a relatively small outlet at the opposite said end of the chamber;

a rotary crusher arm axially mounted for rotation in the tapered chamber;

a rotor head axially disposed in the tapered chamber and carrying said crusher arm for rotation;

a plurality of vanes disposed along the inner surface of the tapered chamber and extending inwardly of the said chamber thereof, said rotary crusher arm and said vanes being cooperatively disposed to convey scrap inserted into the inlet of the tapered chamber towards the outlet of the chamber while simultaneously crushing said scrap;

a throat formed having a wall and disposed adjacent the outlet of the chamber for passage of crushed scrap therethrough, and a discharge chute in communication with said outlet;

means for automatically enlarging the throat upon jamming of the crusher to permit material causing the jamming to pass through the throat to the discharge chute;

the enlarging means including a door disposed in the wall of the throat and in a part of the tapered chamber adjacent the outlet end thereof, said door being movable along a lineal path radially outwardly upon the occurrence of jamming, the enlarging means further including a fluid-operated cylinder being one of a hydraulic and pneumatic type and operatively connected to the door for opening the door upon occurrence of jamming, the enlarging means including means for reversing the action of the fluid-operated cylinder to close the said door in movement upon its lineal path towards the tapered chamber and its communicating throat, said tapered chamber being arranged generally vertically;

whereby upon jamming of the crusher the said door comprising a part of the tapered chamber and its communicating throat moving radially lineally outwardly to allow passage of the jam inducing material to pass through the throat and to the discharge chute to alleviate the jamming condition.

2. The invention of claim 1 and wherein said discharge chute being arranged beneath the throat and the door formed enlarging means.

3. The crusher as set forth in claim 1 wherein the enlarging means includes means for causing the door to close substantially as soon as it reaches its fully open position.

4. The crusher as set forth in claim 1 wherein the enlarging means includes means for closing the door automatically upon the expiration of a preset interval of time after the door begins opening.

5. The crusher as set forth in claim 1 wherein the enlarging means includes means for sensing the speed of rotation of the rotary crusher arm, said enlarging means being responsive to the speed of rotation falling below a preset level to stop the rotation and enlarge the throat.

6. The crusher as set forth in claim 5 wherein the enlarging means includes means for reversing the direction of rotation of the rotary crusher arm, said enlarging means being responsive to the speed of rotation falling below the preset level to stop the rotation and then reverse the direction of rotation while enlarging the throat.

7. The crusher as set forth in claim 6 wherein the enlarging means includes means for reversing the direction of rotation a preset number of times.

8. The crusher as set forth in claim 1 wherein the enlarging means includes means for reversing the direction of rotation of the rotary crusher arm while enlarging the throat.

* * * * *